US007637040B2

(12) United States Patent
Wu et al.

(10) Patent No.: US 7,637,040 B2
(45) Date of Patent: Dec. 29, 2009

(54) GLOVE IRON

(75) Inventors: Wan-Hua Wu, Taipei (TW); Ching-Ching Ho, Taipei (TW); Chun-Hsien Wu, Taipei (TW); Shih-Wei Tung, Taipei (TW); Yi-Hao Lin, Taipei (TW)

(73) Assignee: Tsann Kuen Enterprise Co., Ltd., Xiamen, Fujian (CN)

( * ) Notice: Subject to any disclaimer, the term of this patent is extended or adjusted under 35 U.S.C. 154(b) by 2 days.

(21) Appl. No.: 12/007,909

(22) Filed: Jan. 17, 2008

(65) Prior Publication Data

US 2008/0172914 A1 Jul. 24, 2008

(30) Foreign Application Priority Data

Jan. 19, 2007 (TW) ..... 96201115 U

(51) Int. Cl.
*D06F 75/30* (2006.01)
*D06F 75/38* (2006.01)

(52) U.S. Cl. ..... 38/89; 38/93; 219/211; 2/159

(58) Field of Classification Search ..... 38/74, 38/88, 75, 79, 89, 93, 95; 219/211; 2/211
See application file for complete search history.

(56) References Cited

U.S. PATENT DOCUMENTS

| | | | | | |
|---|---|---|---|---|---|
| 2,314,498 | A * | 3/1943 | Hoagland | 38/141 |
| 3,793,753 | A * | 2/1974 | Engelbart | 38/77.6 |
| 4,089,128 | A * | 5/1978 | Baumgartner et al. | 38/93 |
| 4,517,757 | A * | 5/1985 | Asada et al. | 38/88 |
| 5,541,388 | A * | 7/1996 | Gadd | 219/211 |
| 5,620,621 | A * | 4/1997 | Sontag | 219/211 |
| 5,651,201 | A * | 7/1997 | Farley | 38/88 |
| 6,239,410 | B1 * | 5/2001 | Tackore | 219/211 |
| 6,513,269 | B2 * | 2/2003 | Kobayashi et al. | 38/93 |
| 2005/0155961 | A1 * | 7/2005 | Gilligan et al. | 219/211 |

* cited by examiner

*Primary Examiner*—Ismael Izaguirre
(74) *Attorney, Agent, or Firm*—Rosenberg, Klein & Lee

(57) ABSTRACT

A glove iron comprises a cloth body and a power unit disposed in the cloth body. The cloth body includes a cloth fiber layer, a heat insulation layer, and an electrothermal fiber layer. The cloth fiber layer forms an accommodating space. The power unit is disposed on the cloth fiber layer, and corresponds to the heat insulation layer and the electrothermal fiber layer. The power unit is electrically connected to and provides power for the electrothermal fiber layer. The electrothermal fiber layer can also be replaced with the combination of an electrothermal membrane and a second cloth fiber layer. A user can use the glove type iron to iron a piece of clothing or material.

20 Claims, 11 Drawing Sheets

GLOVE IRON

BACKGROUND OF THE INVENTION

1. Field of the Invention

The present invention relates to a glove iron and, more particularly, to a glove iron, which uses cloth to form several layers of different materials to produce electro-thermal effects similar to that of an iron so that a user can put his hand into the cloth body and flexibly attach the glove iron to a piece of clothing or material by using his or her palm.

2. Description of Related Art

As shown in FIG. 1, a prior art electric iron 1*a* comprises an iron body 10*a*, an ironing plate 11*a* provided at the bottom of the iron body 10*a*, a handle 2*a* formed on the iron body 10*a*, an adjustment knob 13*a* disposed on the iron body 10*a*, and a power cord 14*a* formed on the iron body 10*a*. Electronic components (not shown) in the iron body 10*a* are electrically connected to the power cord 14*a*, and are also electrically connected to the ironing plate 11*a* so that the ironing plate 11*a* can generate heat. The adjustment knob 13*a* controls the power switch of the electronic components of the iron body 10*a*. A user uses the adjustment knob 13*a* to adjust the heat of the ironing plate 11*a*. When the adjustment knob 13*a* is on, electric power is provided for the electronic components via the power cord to allow the ironing plate 11*a* to generate heat.

When in use, the user can hold the handles 2*a* to control the movement of the ironing body 10*a* and place the ironing plate 11*a* on the surface of a piece of clothing or material to be ironed. By applying force, the object can be ironed by the ironing plate 11*a*. The electric iron 1*a*, however, has the following drawbacks:

(1) Because the iron body is bulky and heavy, a larger force is required to overcome the weight of the iron body and the friction generated by the weight of the iron body. Therefore, using the iron requires strenuous effort, and it is inconvenient to control the iron.

(2) Heat generated when the iron is electrified via the power cord remains directly on the ironing plate. The temperature of the ironing plate cannot drop quickly to temperatures the human skin can touch after use. Therefore, burn accidents easily arise due to careless contact with the ironing plate.

(3) Because the conventional electric iron is bulky and heavy, it occupies a large space, and is very inconvenient for storage and transport.

Accordingly, the present invention aims to propose a glove iron to solve the above drawbacks in the prior art.

SUMMARY OF THE INVENTION

An object of the present invention is to provide a glove iron, wherein several layers of different materials are arranged on a cloth body to form a glove having the same electrothermal effect as a conventional electric iron. A user can conveniently put his or her palm in the accommodating space of the cloth body to use the glove iron to iron a piece of clothing or material (e.g., a business suit, a pair of trousers, or an overcoat). Through the flexible and elastic characteristics of the cloth body, the user can freely select any portion of this object for ironing. In addition to convenient use, the advantages of easy storage and transport can also be accomplished.

To achieve the above object, the present invention provides a glove iron, which comprises a cloth body and a power unit disposed on the cloth body.

The cloth body is similar to a glove, and includes a cloth fiber layer, a heat insulation layer disposed on the cloth fiber layer, and an electrothermal fiber layer disposed on the heat insulation layer. The cloth fiber layer has an inner surface and an outer surface. The inner surface of the cloth fiber layer forms an accommodating space. The heat insulation layer is formed on the outer surface of the cloth fiber layer. The electrothermal fiber layer is correspondingly disposed on the surface of the heat insulation layer. The power unit is disposed on the outer surface of the cloth fiber layer, and corresponds to the heat insulation layer and the electrothermal fiber layer. The power unit is electrically connected to the electrothermal fiber layer, and provides power for the electrothermal fiber layer to generate heat.

A user can freely put his or her palm in the accommodating space to control the cloth fiber layer to use the glove iron to iron a piece of clothing or material so as to iron the object through heat generated by the electrothermal fiber layer. The heat insulation layer prevents the heat from being conducted into the accommodating space that would otherwise burn the user's palm.

To achieve the above object, the present invention also provides another glove iron, which comprises a cloth body and a power unit disposed on the cloth body.

The cloth body is shaped like a glove, and includes a first cloth fiber layer, a heat insulation layer disposed on the first cloth fiber layer, a flexible electrothermal membrane disposed on the heat insulation layer, and a second cloth fiber layer covering the first cloth fiber layer, the heat insulation layer and the electrothermal membrane.

The first cloth fiber layer has a first inner surface and a first outer surface. The first inner surface of the first cloth fiber layer forms an accommodating space. The second cloth fiber layer has a second inner surface and a second outer surface. The second inner surface and the first outer surface together cover the electrothermal membrane and the heat insulation layer. The heat insulation layer is formed on the first outer surface of the first cloth fiber layer. The electrothermal membrane is correspondingly disposed on the surface of the heat insulation layer. The power unit is disposed on the second outer surface of the second cloth fiber layer, and corresponds to the heat insulation layer and the electrothermal membrane. The power unit is electrically connected to the electrothermal membrane, and provides power for the electrothermal membrane to generate heat.

A user can freely put his or her palm in the accommodating space to control the second cloth fiber layer to use the glove iron to iron a piece of clothing or material so as to iron the object through heat generated by the electrothermal membrane. The heat insulation layer prevents the heat from being conducted into the accommodating space where it would otherwise burn the user's palm.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

Figure 1:
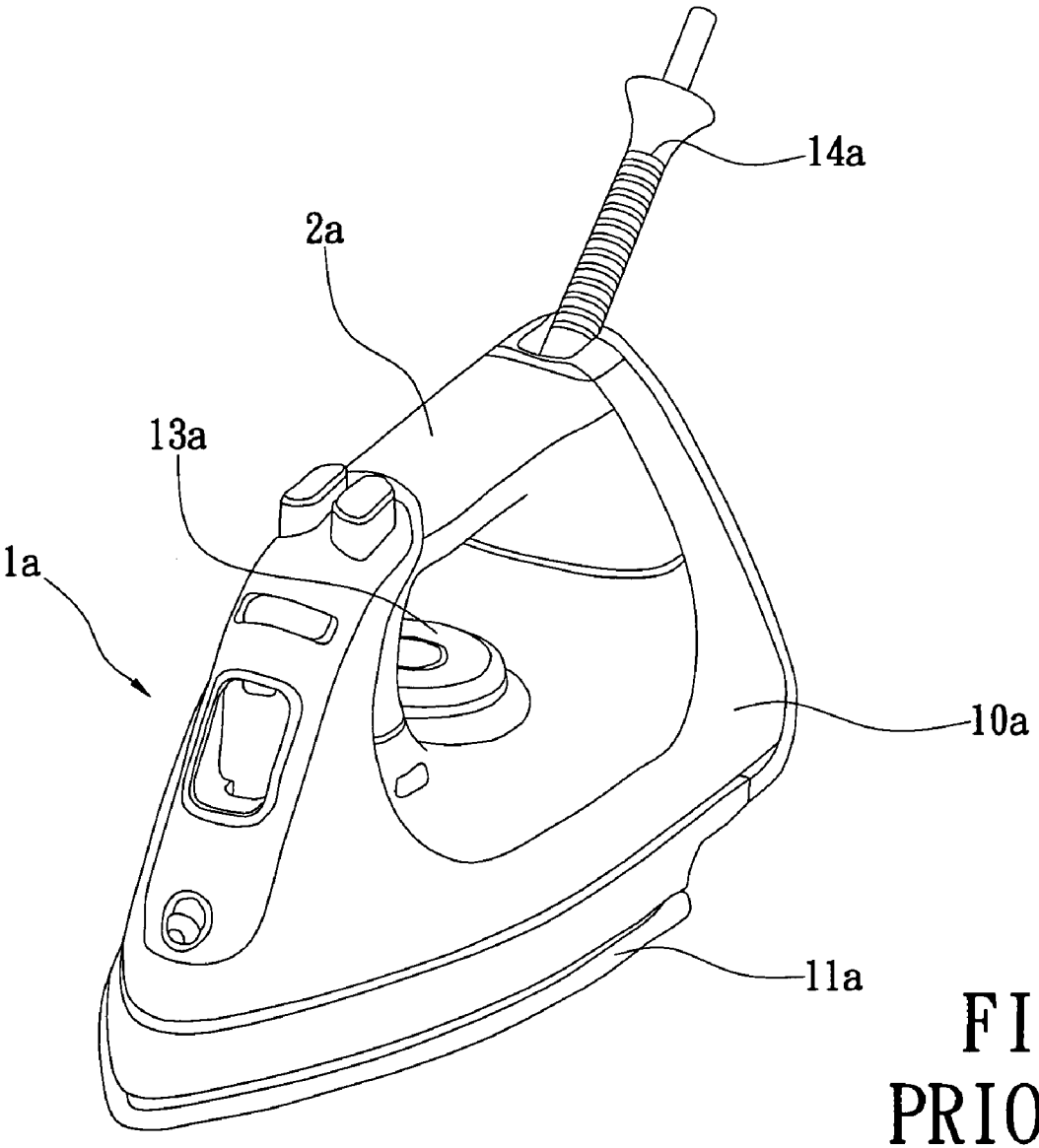
FIG. 1 PRIOR ART
FIG. 1 is a perspective view of a prior art electric iron.
Figure 2:
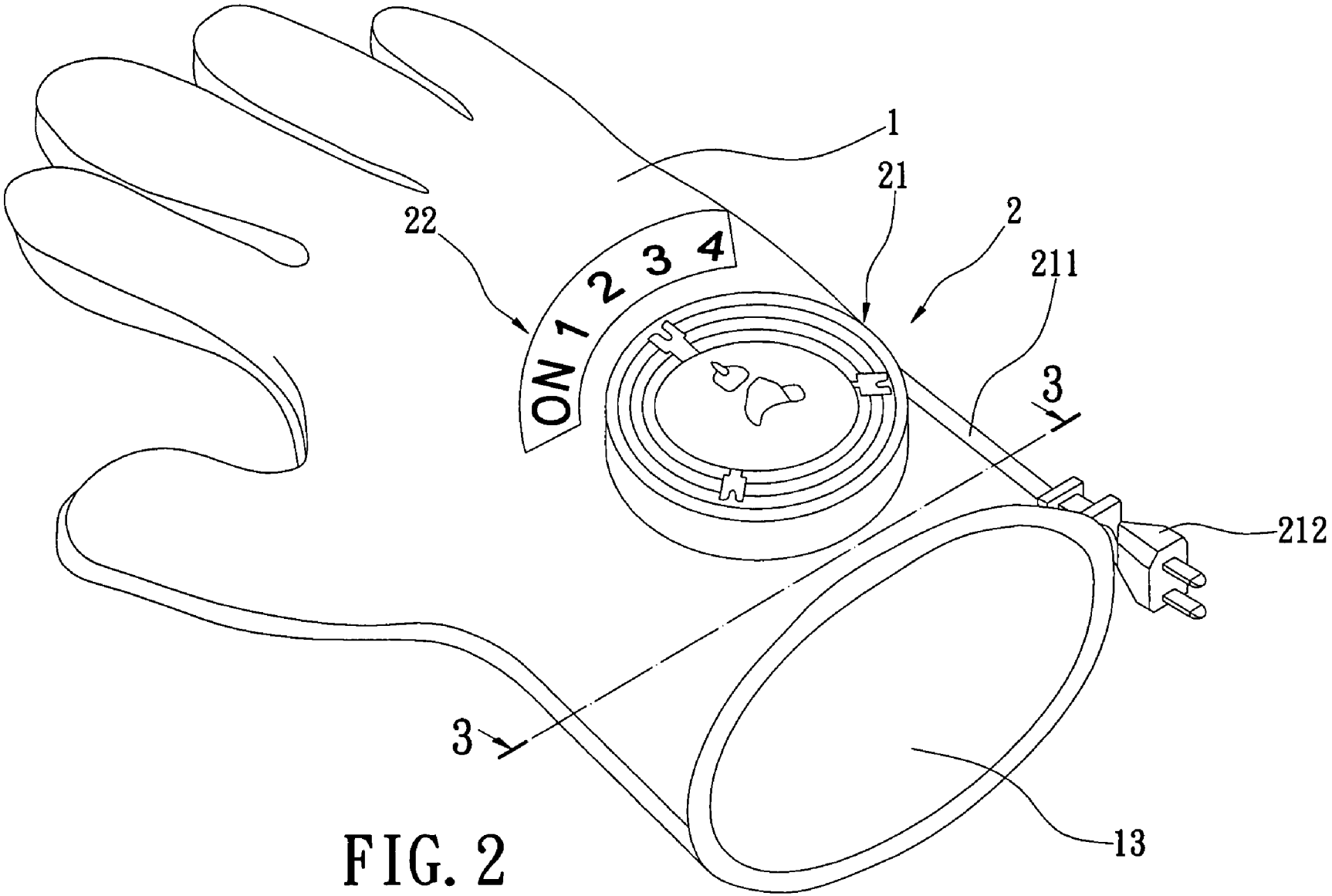
FIG. 2 is a perspective view of the glove iron of the present invention.
Figure 3:
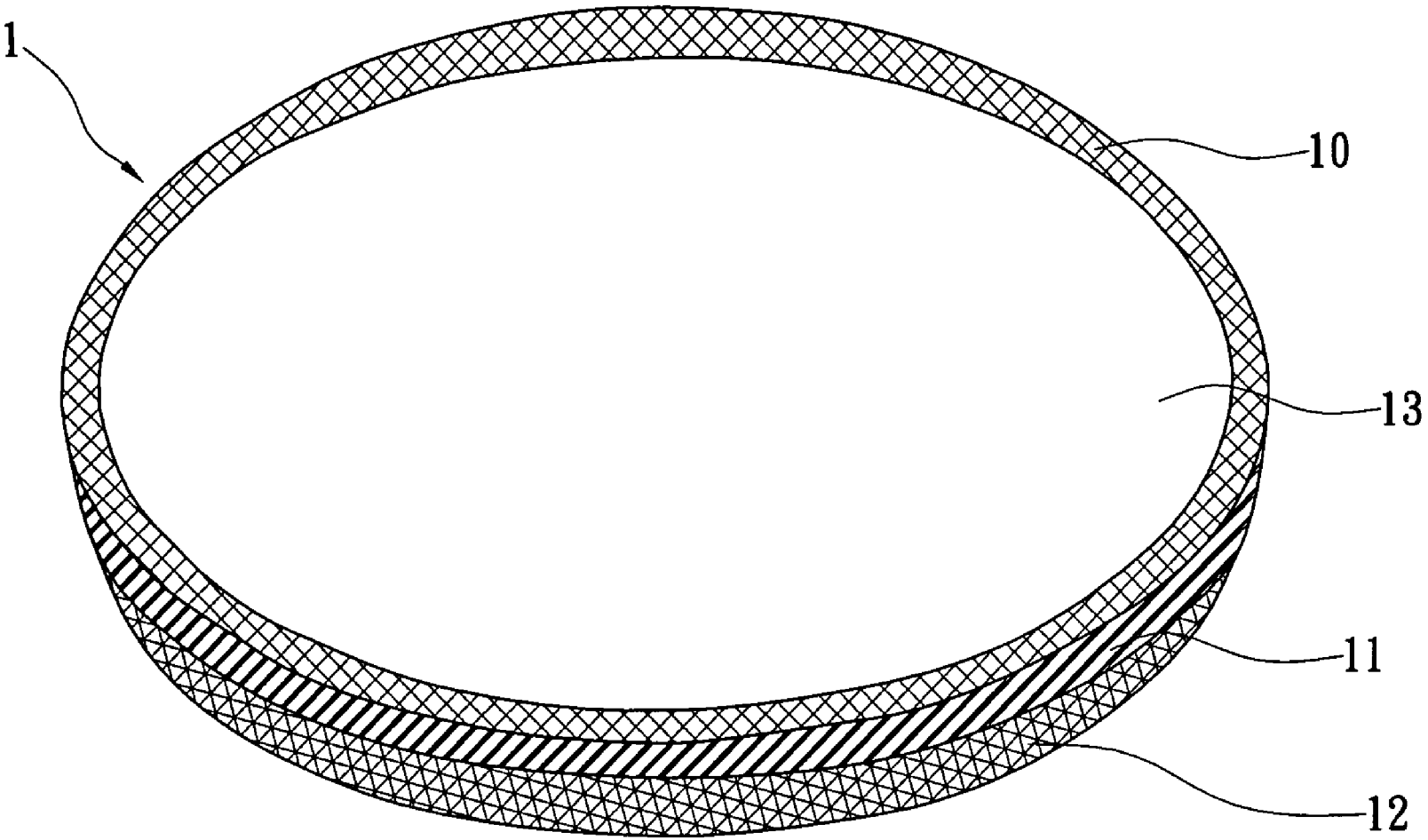
FIG. 3 is a cross-sectional view according to a first embodiment of the cloth body along line 3-3 as shown in FIG. 2.

FIG. 2 is a perspective view of the glove iron of the present invention. FIG. 3 is a cross-sectional view according to a first embodiment of the cloth body along line 3-3 as shown in FIG. 2. As shown in FIGS. 2 and 3, a glove iron according to the first embodiment of the present invention comprises a glove-shaped cloth body 1 and a power unit 2 disposed on the surface of the cloth body 1.

As shown in FIG. 3, the cloth body 1 includes a cloth fiber layer 10, a heat insulation layer 11 disposed on the cloth fiber layer 10, and an electrothermal fiber layer 12 disposed on the heat insulation layer 11. The cloth fiber layer 10 has an inner surface 101 and an outer surface 102. The inner surface 101 of the cloth fiber layer 10 forms an accommodating space 13. The heat insulation layer 11 is disposed on the outer surface 102 of the cloth fiber layer 10. The electrothermal fiber layer 12 is correspondingly disposed on the surface of the heat insulation layer 11. The power unit 2 is disposed on the outer surface 102 of the cloth fiber layer 10 and corresponds to the heat insulation layer 11 and the electrothermal fiber layer 12. The power unit 2 is electrically connected to the electrothermal fiber layer 12 via an electric cord (not shown) to provide power for the electrothermal fiber layer 12 to generate heat.

Through the design of the cloth body 1, a user can put his or her palm in the accommodating space 13 to use the glove iron to iron a piece of clothing or material (e.g., a business suit, a pair of trousers, or an overcoat) via the cloth fiber layer 10 and heat generated by the electrothermal fiber layer 12. The heat insulation layer 11 prevents heat from being conducted into the accommodating space 13 that would otherwise burn the user's palm.

Figure 4:
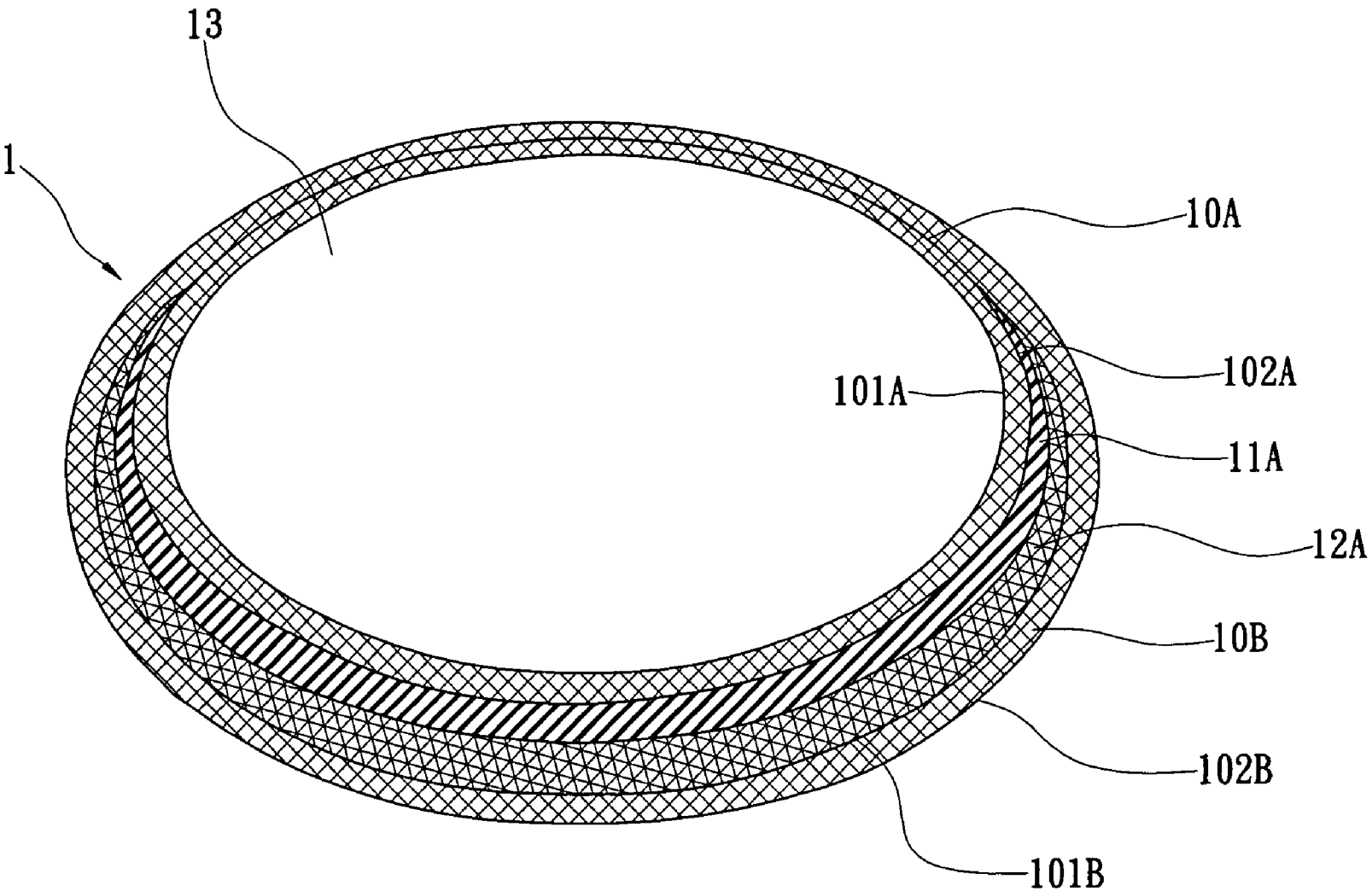
FIG. 4 is a cross-sectional view according to a second embodiment of the cloth body along line 3-3 shown in FIG. 2.

FIG. 2 is a perspective view of the glove iron of the present invention. FIG. 4 is a cross-sectional view according to a second embodiment of the cloth body along line 3-3 as shown in FIG. 2. As shown in FIGS. 2 and 4, a glove iron according to the second embodiment of the present invention comprises a glove-shaped cloth body 1 and a power unit 2 disposed on the surface of the cloth body 1.

As shown in FIG. 4, the cloth body 1 includes a first cloth fiber layer 10A, a heat insulation layer 11A disposed on the first cloth fiber layer 10A, a flexible electrothermal membrane 12A disposed on the heat insulation layer 11A, and a second cloth fiber layer 10B covering the first cloth fiber layer 10A, the heat insulation layer 11A, and the electrothermal membrane 12A.

The first cloth fiber layer 10A has a first inner surface 10A and a first outer surface 102A. The first inner surface 10A of the first cloth fiber layer 10A forms an accommodating space 13. The second cloth fiber layer 10B has a second inner surface 101B and a second outer surface 102B. The second inner surface 101B and the first outer surface 102A together cover the electrothermal membrane 12A and the heat insulation layer 11A. The heat insulation layer 11A is disposed on the first outer surface 102A of the first cloth fiber layer 10A. The electrothermal membrane 12A is correspondingly disposed on the surface of the heat insulation layer 11A.

The power unit 2 is disposed on the second outer surface 102B of the second cloth fiber layer 10B and corresponds to the heat insulation layer 11A and the electrothermal membrane 12A. The power unit 2 is electrically connected to the electrothermal membrane 12A to provide power for the electrothermal membrane 12A to generate heat.

Through the design of the cloth body 1, a user can freely put his or her palm in the accommodating space 13 to use the glove iron to iron a piece of clothing or material (e.g., a business suit, a pair of trousers, or an overcoat) via the first and second cloth fiber layers 10A and 10B and the heat generated by the electrothermal membrane 12A. The heat insulation layer 11A is used for heat insulation and prevents heat from being conducted into the accommodating space 13 that would otherwise burn the user's palm.

FIG. 2 is also a perspective view of the power unit of the glove iron of the present invention. As shown in FIG. 2, the power unit 2 is a plug power module. When the power unit is disposed on the cloth body 1 shown in FIG. 3, the power unit 2 has a reel structure 21 electrically connected to the electrothermal fiber layer 12 and a controller 22 for controlling the reel structure 21. When the power unit 2 is disposed on the cloth body 1 shown in FIG. 4, the power unit 2 has a reel structure 21 electrically connected to the electrothermal membrane 12A and a controller 22 for controlling the reel structure 21.

Figure 5:
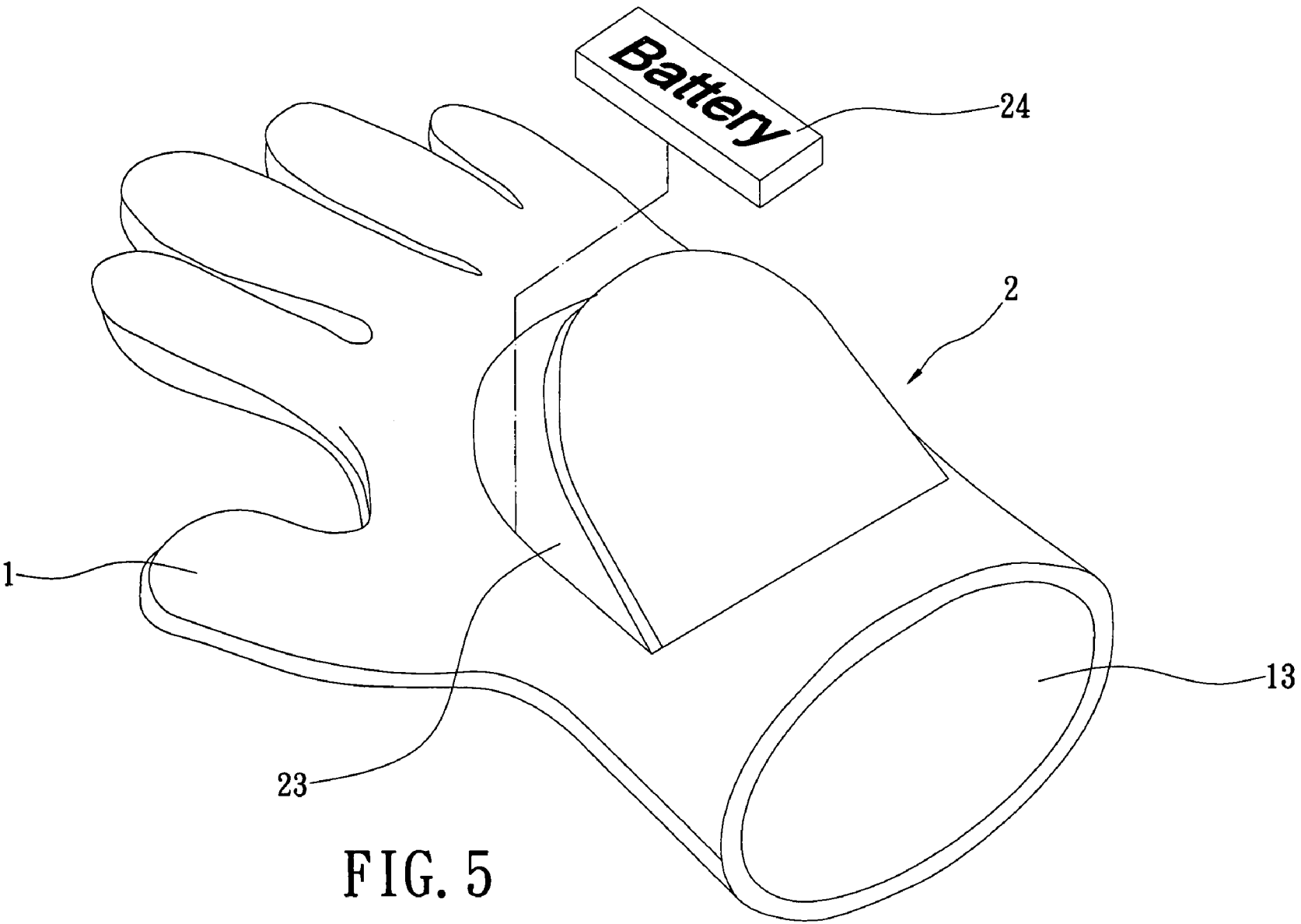
FIG. 5 is a perspective view according to a first embodiment of the power unit of the glove iron of the present invention.

The reel structure 21 has a reel module 211 and a plug 212 connected to the reel module 211. The reel module 211 can be wound or unwound to retract or draw the plug 212. The controller 22 is used to adjust the magnitude of heat generation of the cloth body 1. A user can thus utilize the reel structure 21 to make the cloth body 1 to generate heat. Moreover, the reel structure 21 can be wound up to occupy less space when not in use. FIG. 5 is a perspective view according to a first embodiment of the power unit of the glove iron of the present invention. As shown in FIG. 5, the power unit 2 is a battery power module. When the power unit is disposed on the cloth body 1 as shown in FIG. 3, the power unit 2 has a battery holder 23 electrically connected to the electrothermal fiber layer 12 and a battery 24 disposed on the battery holder 23. When the power unit 2 is disposed on the cloth body 1 as shown in FIG. 4, the power unit 2 has a battery holder 23 electrically connected to the electrothermal membrane 12A and a battery 24 disposed on the battery holder 23. The user can thus take the glove iron with him or her for use without worrying about whether there are any power sockets or not and whether the plug connectors are a matching type or not.

Figure 6:
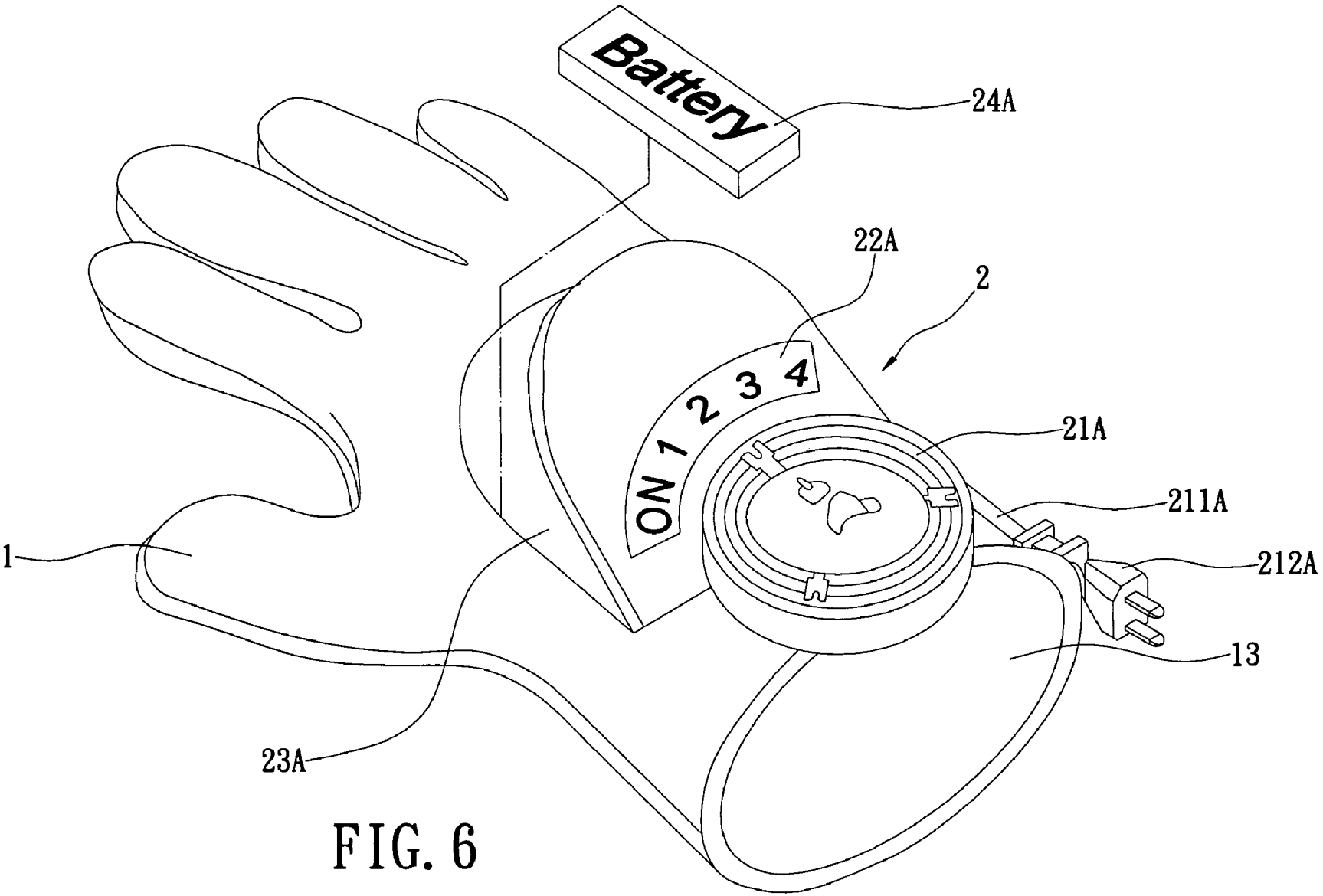
FIG. 6 is a perspective view according to a second embodiment of the power unit of the glove iron of the present invention.

FIG. 6 is a perspective view according to a second embodiment of the power unit of the glove iron of the present invention. As shown in FIG. 6, the power unit 2 is a combinational power module. When the power unit 2 is disposed on the cloth body 1 as shown in FIG. 3, the power unit 2 has a plug power structure electrically connected to the electrothermal fiber layer 12 and a battery power structure electrically connected to the plug power structure. The plug power structure has a reel structure 21A electrically connected to the electrothermal fiber layer 12 and a controller 22A for controlling the reel structure 21A. The battery power structure has a battery holder 23A electrically connected to the electrothermal fiber layer 12 and a battery 24A disposed on the battery holder 23A. When the power unit is disposed on the cloth body 1 as shown in FIG. 4, the power unit 2 has a plug power structure electrically connected to the electrothermal membrane 12A and a battery power structure electrically connected to the plug power structure. The plug power structure has a reel structure 21A electrically connected to the electrothermal membrane 12A and a controller 22A for controlling the reel structure 21A. The battery power structure has a battery holder 23A electrically connected to the electrothermal membrane 12A and a battery 24A disposed on the battery holder 23A.

The reel structure 21A has a reel module 211A and a plug 212A connected to the reel module 211A. The reel module 211A can be wound or unwound to retract or draw the plug 212A. The controller 22A is used to adjust the magnitude of heat generation of the cloth body 1. By selecting different electrical connection methods the glove iron can thereby be provided for users.

Figure 7:
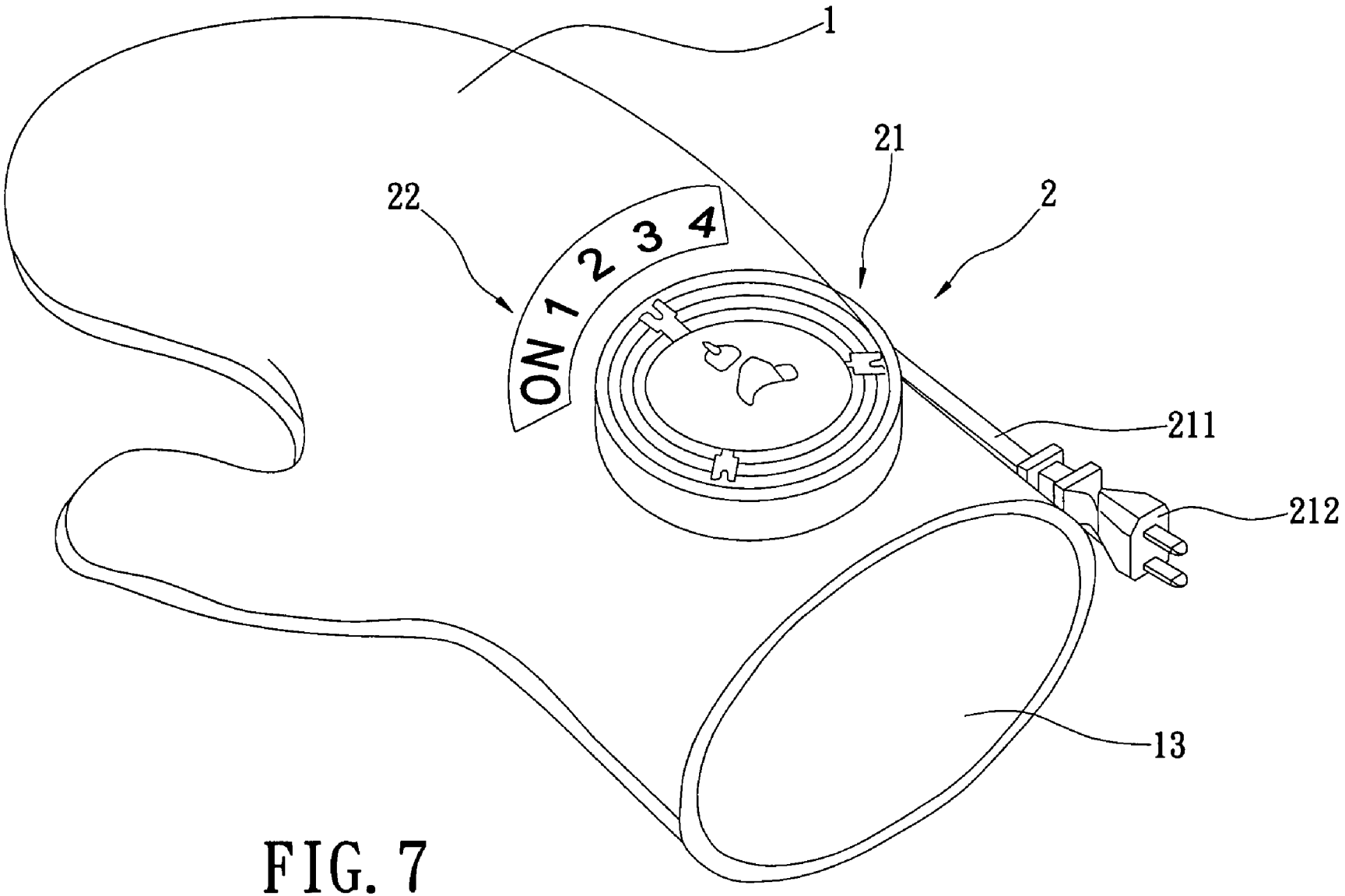
FIG. 7 is a perspective view of the glove iron with a palm-shaped cloth body of the present invention.

Moreover, in the present invention, the cloth body 1 of the glove iron can be different shapes. For instance, the cloth body 1 is a five-finger shaped glove in FIGS. 2, 5 and 6. In FIG. 7, the cloth body 1 is a palm-shaped glove. The material and structure of the cloth body 1 can be those shown in FIG. 3 or 4. The power unit 2 can draw power from the above plug power module, battery type power module, or a combinational battery module. In other words, various selections of the cloth body 1 and the power units 2 can be provided for users.

Figure 8:
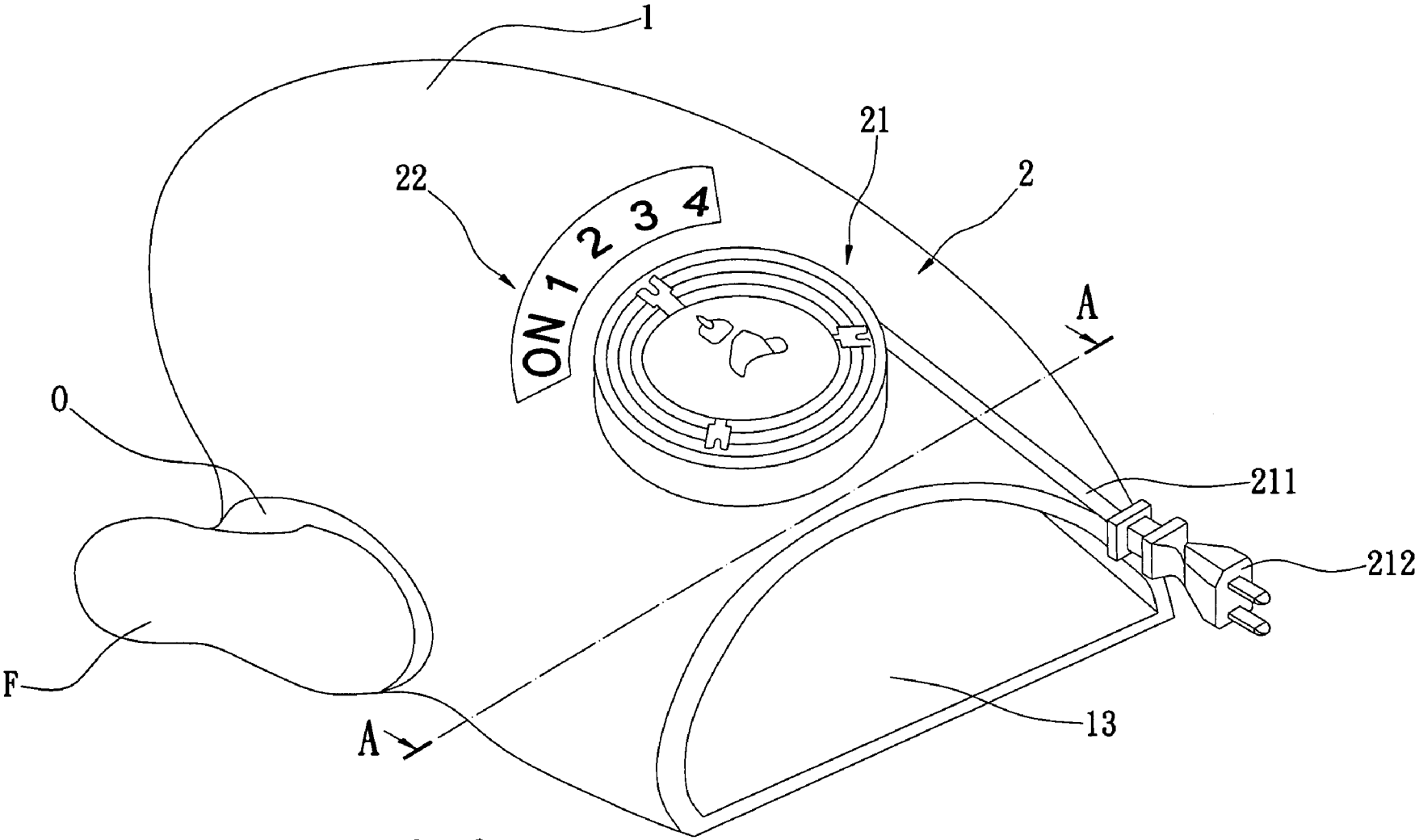
FIG. 8 is a perspective view of the glove iron with a palm-shaped cloth body embodiment of the present invention.
Figure 8A:
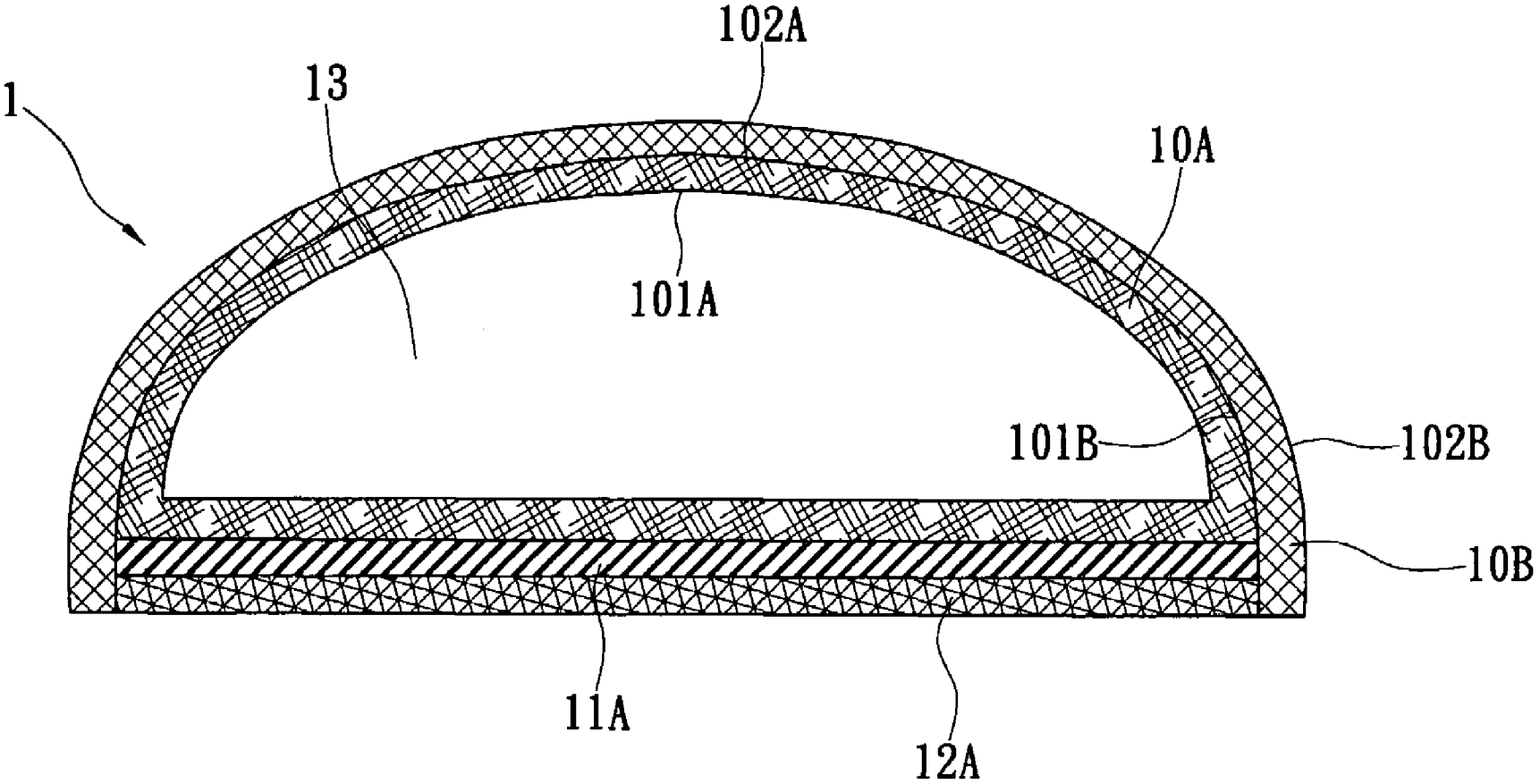
FIG. 8A is a cross-sectional view of the glove iron of FIG. 8 along line A-A.

As shown in FIGS. 8 and 8A, the cloth body 1 is a palm-shaped glove. The cloth body 1 includes a first cloth fiber layer 10A, a heat insulation layer 11A disposed on the first cloth fiber layer 10A, a flexible electrothermal membrane 12A disposed on the first cloth fiber layer 10A, and a second cloth fiber layer 10B covering the first cloth fiber layer 10A, the heat insulation layer 11A and the electrothermal membrane 12A.

The first cloth fiber layer 10A has a first inner surface 10A and a first outer surface 102A. The first inner surface 101A of the first cloth fiber layer 10A forms an accommodating space 13. The second cloth fiber layer 10B has a second inner surface 10B and a second outer surface 102B. The second inner surface 101B and the first outer surface 102A together cover the electrothermal membrane 12A and the heat insulation layer 11A. The heat insulation layer 11A is disposed on the outer surface 102A of the first cloth fiber layer 10A. The electrothermal membrane 12A is correspondingly disposed on the surface of the heat insulation layer 11A. The power unit 2 is disposed on the second outer surface 102B of the second cloth fiber layer 10B and corresponds to the heat insulation layer 11A and the electrothermal membrane 12A. The power unit 2 is electrically connected to the electrothermal membrane 12A to provide power for the electrothermal membrane 12A to generate heat. The power unit 2 can be the above plug power module, a battery type power module, or a combinational battery module.

The first cloth fiber layer 10A is made of a soft material. The second cloth fiber layer 10B is made of a hard material. Moreover, an opening O is formed at a predetermined position of the cloth body 1. A thumb portion F made of a soft material is disposed at the opening O. The thumb portion F is composed of a cloth material layer.

Figure 9:
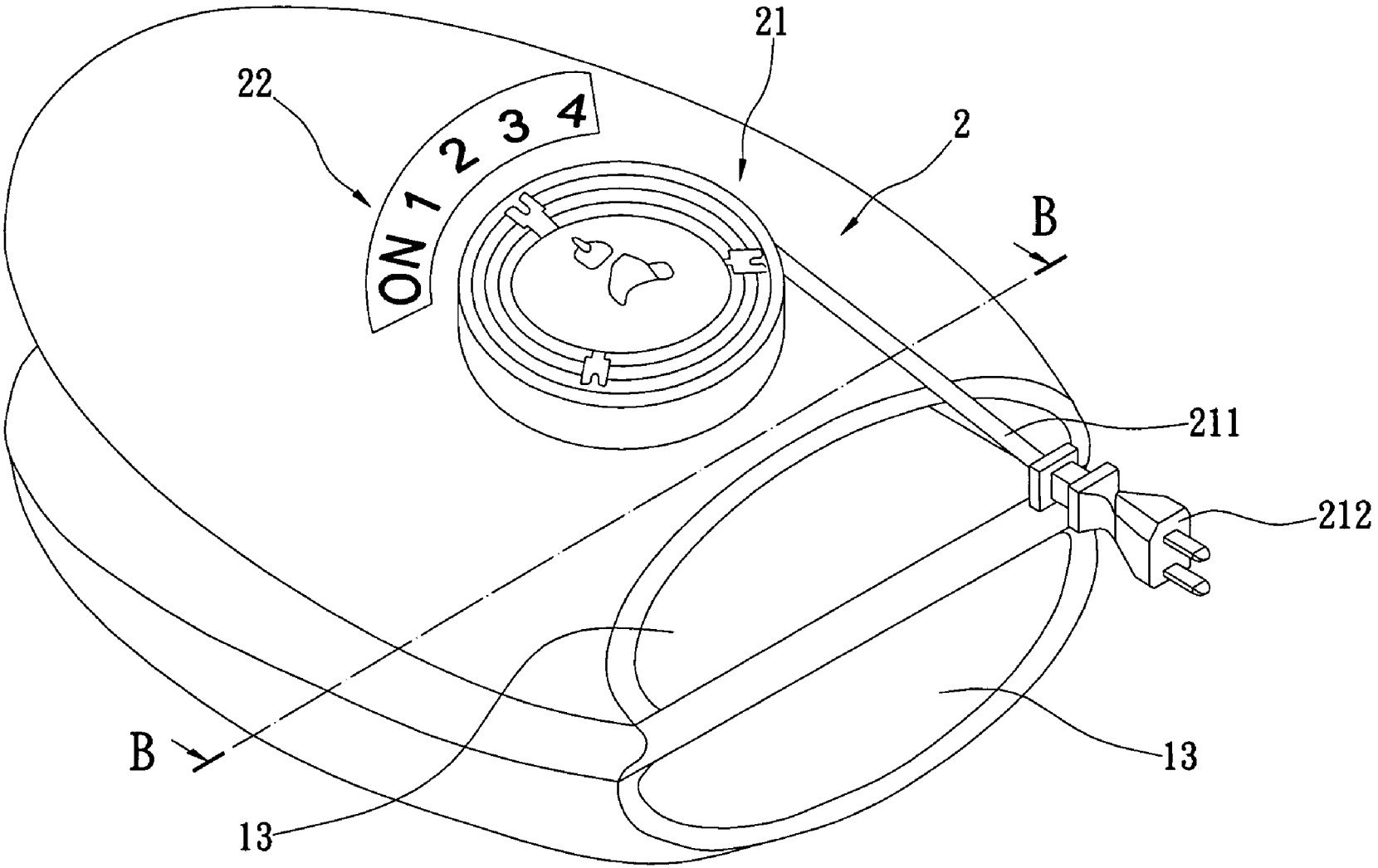
FIG. 9 is a perspective view of the grove iron with a clip type palm-shaped cloth body.
Figure 9A:
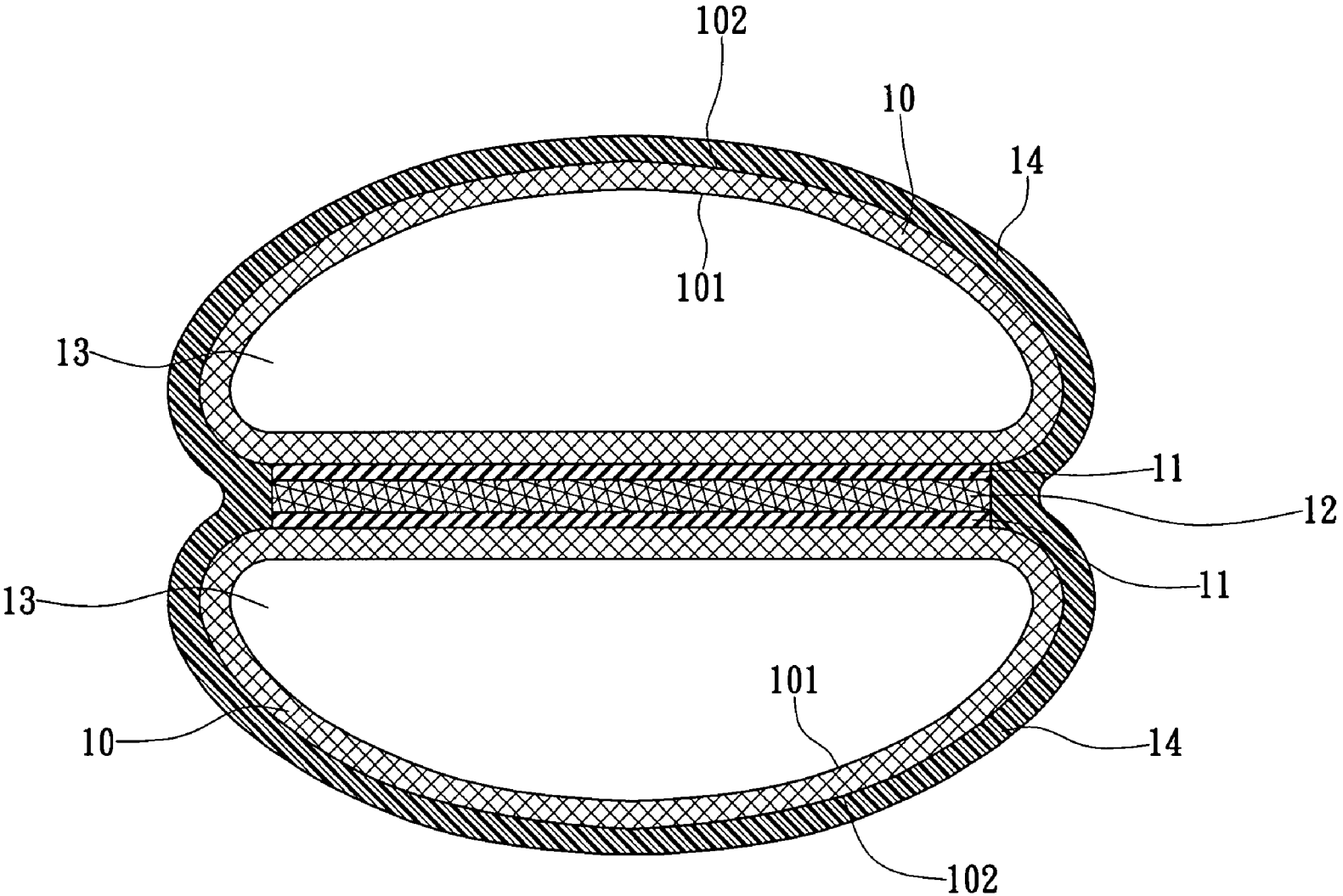
FIG. 9A is a cross-sectional view of the glove iron of FIG. 9 along line B-B.

As shown in FIGS. 9 and 9B, the cloth body 1 is a clip glove. The power unit 2 is disposed on the surface of the cloth body 1. The power unit 2 can be the above plug power module, a battery type power module, or a combinational battery module.

As shown in FIG. 9B, the cross section of the cloth body 1 is shaped like the number 8. The cloth body 1 has two cloth fiber layers 10, two heat insulation layers 11 disposed on the two cloth fiber layers 10, an electrothermal fiber layer 12 disposed between the two heat insulation layers 11, and a silicone layer 14 covering the two cloth fiber layers 10, the two heat insulation layers, 11 and the electrothermal fiber layer 12.

Each of the two cloth fiber layers 10 has an inner surface 101 and an outer surface 102. Each inner surface 101 forms an accommodating space 13. Each heat insulation layer 11 is disposed on the outer surface 102 of one of the two cloth fiber layers 10, and the electrothermal fiber layer 12 is correspondingly disposed between the two heat insulation layers 11, thereby forming a stacked structure. A user can use the silicone layer 14 and the cloth fiber layers 10 to clip a piece of clothing or material and then use the electrothermal fiber layer 12 to iron a piece of clothing or material.

To sum up, the glove iron of the present invention has the following advantages:

(1) By using different material layers, the cloth body generates heat just as a conventional electric iron does so that a user can easily control the glove iron to iron clothing.

(2) Different type power units can be disposed on the cloth body. Moreover, a reel structure is used to facilitate electric connection with the glove iron.

(3) Because the heat generating part (e.g., the electrothermal fiber layer or electrothermal membrane) of the cloth body is provided in the cloth body, no heat generating part will be exposed when ironing clothing. Therefore, careless contact with the heat generating part won't occur when a user takes standard precautions.

(4) The cloth body can be designed as different gloves to provide a number of choices for users. Users can choose a more practical glove according to their preferences.

(5) Users can flexibly attach the glove iron to the surface of a piece of clothing or material so the entire of area of the clothing or material will be ironed leaving no areas wrinkled or unpressed.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A glove iron comprising:

a cloth body shaped like a glove, the cloth body including a cloth fiber layer, a heat insulation layer disposed on the cloth fiber layer, and an electrothermal fiber layer disposed on the heat insulation layer, the cloth fiber layer having an inner surface and an outer surface, the inner surface of the cloth fiber layer forming an accommodating space, the heat insulation layer being formed on the outer surface of the cloth fiber layer, the electrothermal fiber layer being correspondingly disposed on a surface of the heat insulation layer; and a power unit disposed on the outer surface of the cloth fiber layer and corresponding to the heat insulation layer and the electrothermal fiber layer, the power unit being electrically connected to the electrothermal fiber layer and providing power for the electrothermal fiber layer to generate heat, the power unit being a combinational power module having a plug power structure electrically connected to the electrothermal fiber layer and a battery power structure electrically connected to the plug power structure, the plug power structure including a reel structure electrically connected to the electrothermal fiber layer and a controller for controlling the reel structure, the battery power structure including a battery holder electrically connected to the electrothermal fiber layer and a battery disposed on the battery holder;

whereby a user can freely put his or her palm in the accommodating space to control the cloth fiber layer and flexibly attach the glove iron so as to iron a piece of clothing or material through heat generated by the electrothermal fiber layer, the heat insulation layer prevents the heat from being conducted into the accommodating space that would otherwise burn the user's palm.

2. The glove iron as claimed in claim 1, wherein the power unit is a plug power module, and includes a reel structure electrically connected to the electrothermal fiber layer and a controller for controlling the reel structure.

3. The glove iron as claimed in claim 2, wherein the reel structure includes a reel module and a plug connected to the reel module, and the controller is used to switch and adjust the power of the reel module.

4. The glove iron as claimed in claim 1, wherein the power unit is a battery type power module, which includes a battery holder electrically connected to the electrothermal fiber layer and a battery disposed on the battery holder.

5. The glove iron as claimed in claim 1, wherein the reel structure includes a reel module and a plug connected to the reel module, the controller being used to switch and adjust the power of the reel module.

6. The glove iron as claimed in claim 1, wherein the cloth body is a five-finger shaped glove.

7. The glove iron as claimed in claim 1, wherein the cloth body is a palm-shaped glove.

8. The glove iron as claimed in claim 1, wherein the cloth body is a palm-shape glove, the cloth fiber layer of the cloth body is made of hard material, and a thumb portion made of soft material is disposed at a predetermined position of the cloth body.

9. The glove iron as claimed in claim 1, wherein the cloth body is a clip type glove, the cloth body further comprising a silicone layer, and the silicone layer being disposed on the outer surface of the cloth fiber layer.

10. A glove iron comprising:

a cloth body of a glove, the cloth body including a first cloth fiber layer, a heat insulation layer disposed on the first cloth fiber layer, a flexible electrothermal membrane disposed on the heat insulation layer, and a second cloth fiber layer covering the first cloth fiber layer, the heat insulation layer and the electrothermal membrane, the first cloth fiber layer having a first inner surface and a first outer surface, the first inner surface of the first cloth fiber layer forming an accommodating space, the second cloth fiber layer having a second inner surface and a second outer surface, the second inner surface and the first outer surface together covering the electrothermal membrane and the heat insulation layer, the heat insulation layer being formed on the first outer surface of the first cloth fiber layer, the electrothermal membrane being correspondingly disposed on a surface of the heat insulation layer; and a power unit disposed on the second outer surface of the second cloth fiber layer and corresponding to the heat insulation layer and the electrothermal membrane, the power unit being electrically connected to the electrothermal membrane and providing power for the electrothermal membrane to generate heat;

whereby a user can freely put his or her palm in the accommodating space to control the second cloth fiber layer and flexibly attach the glove iron to iron a piece of clothing or material through heat generated by the electrothermal membrane, the heat insulation layer prevents heat from being conducted into the accommodating space that would otherwise burn the user's palm.

11. The glove iron as claimed in claim 10, wherein the power unit is a plug power module, and includes a reel structure electrically connected to the electrothermal membrane and a controller for controlling the reel structure.

12. The glove iron as claimed in claim 11, wherein the reel structure includes a reel module and a plug connected to the reel module, the controller being used to switch and adjust the power of the reel module.

13. The glove iron as claimed in claim 10, wherein the power unit is a battery type power module, which includes a battery holder electrically connected to the electrothermal membrane and a battery disposed on the battery holder.

14. The glove iron as claimed in claim 10, wherein the power unit is a combinational power module, which has a plug power structure electrically connected to the electrothermal membrane and a battery power structure electrically connected to the plug power structure.

15. The glove iron as claimed in claim 14, wherein the plug power structure includes a reel structure electrically connected to the electrothermal membrane and a controller for controlling the reel structure, and the battery power structure includes a battery holder electrically connected to the electrothermal membrane and a battery disposed on the battery holder.

16. The glove iron as claimed in claim 15, wherein the reel structure includes a reel module and a plug connected to the reel module, the controller being used to switch and adjust the power of the reel module.

17. The glove iron as claimed in claim 10, wherein the cloth body is a five-finger shaped glove.

18. The glove iron as claimed in claim 10, wherein the cloth body is a palm-shaped glove.

19. The glove iron as claimed in claim 10, wherein the cloth body is a palm-shape glove, the second cloth fiber layer of the cloth body is made of hard material, and a thumb portion made of soft material is disposed at a predetermined position of the cloth body.

20. The glove iron as claimed in claim 10, wherein the cloth body is a clip type glove, the cloth body further comprising a silicone layer, and the silicone layer being disposed on the second outer surface of the second cloth fiber layer.

* * * * *